US009194058B2

(12) United States Patent
Sharma et al.

(10) Patent No.: US 9,194,058 B2
(45) **Date of Patent: *Nov. 24, 2015**

(54) ELECTROSPINNING PROCESS FOR MANUFACTURE OF MULTI-LAYERED STRUCTURES

(71) Applicant: Arsenal Medical, Inc., Watertown, MA (US)

(72) Inventors: Upma Sharma, Somerville, MA (US); Quynh Pham, Metheun, MA (US); John Marini, Weymouth, MA (US); Xuri Yan, Boston, MA (US); Lee Core, Needham, MA (US)

(73) Assignee: Arsenal Medical, Inc., Watertown, MA (US)

( * ) Notice: Subject to any disclaimer, the term of this patent is extended or adjusted under 35 U.S.C. 154(b) by 321 days.

This patent is subject to a terminal disclaimer.

(21) Appl. No.: 13/758,173

(22) Filed: Feb. 4, 2013

(65) Prior Publication Data

US 2013/0241115 A1 Sep. 19, 2013

Related U.S. Application Data

(63) Continuation-in-part of application No. 13/362,467, filed on Jan. 31, 2012, now Pat. No. 8,968,626.

(60) Provisional application No. 61/437,886, filed on Jan. 31, 2011.

(51) Int. Cl.

| | |
|---|---|
| ***D01D 7/00*** | (2006.01) |
| ***D01D 5/00*** | (2006.01) |
| ***D01D 5/34*** | (2006.01) |

(52) U.S. Cl.

CPC ..... *D01D 5/0061* (2013.01); *D01D 5/0038* (2013.01); *D01D 5/0069* (2013.01); *D01D 5/34* (2013.01)

(58) Field of Classification Search

CPC .. B29C 47/065; D01D 5/0007; D01D 5/0015; D01D 5/0023; D01D 5/003; D01D 5/0038; D01D 5/0046; D01D 5/0053; D01D 5/0061; D01D 5/0069; D01D 5/0076; D01D 5/0084; D01D 5/0092; D01D 5/30; D01D 5/34; D01D 7/00

USPC ..... 264/10, 172.15, 173.16, 173.17, 264/173.18, 173.19, 174.1, 174.11, 211.12, 264/464, 465, 466, 484

See application file for complete search history.

(56) References Cited

U.S. PATENT DOCUMENTS

| | | | |
|---|---|---|---|
| 4,764,377 | A | 8/1988 | Goodson |
| 5,364,627 | A | 11/1994 | Song |

(Continued)

FOREIGN PATENT DOCUMENTS

| | | | |
|---|---|---|---|
| WO | WO-94/18956 | A1 | 9/1994 |
| WO | WO-98/53768 | A1 | 12/1998 |

(Continued)

OTHER PUBLICATIONS

Bini, T.B. et al., "Electrospun poly(L-lactide-co-glycolide) biodegradable polymer nanofiber tubes for peripheral nerve regeneration", Nanotechnology, 15, 2004, 1459-1464.

(Continued)

*Primary Examiner* — Leo B Tentoni

(74) *Attorney, Agent, or Firm* — Kacvinsky Daisak Bluni PLLC

(57) ABSTRACT

Devices and methods for high-throughput manufacture of concentrically layered nanoscale and microscale fibers by electrospinning are disclosed. The devices include a hollow tube having a lengthwise slit through which a core material can flow, and can be configured to permit introduction of sheath material at multiple sites of Taylor cone formation formation.

20 Claims, 12 Drawing Sheets

(56) References Cited

U.S. PATENT DOCUMENTS

| | | | |
|---|---|---|---|
| 5,538,735 | A | 7/1996 | Ahn |
| 5,567,612 | A | 10/1996 | Vacanti et al. |
| 5,569,528 | A | 10/1996 | Van der Loo et al. |
| 5,700,476 | A | 12/1997 | Rosenthal et al. |
| 5,842,477 | A | 12/1998 | Naughton et al. |
| 5,922,340 | A | 7/1999 | Berde et al. |
| 5,944,341 | A | 8/1999 | Kimura et al. |
| 5,980,927 | A | 11/1999 | Nelson et al. |
| 6,086,911 | A | 7/2000 | Godbey |
| 6,214,370 | B1 | 4/2001 | Nelson et al. |
| 6,382,526 | B1 | 5/2002 | Reneker et al. |
| 6,495,124 | B1 | 12/2002 | Samour |
| 6,520,425 | B1 | 2/2003 | Reneker |
| 6,524,608 | B2 | 2/2003 | Ottoboni et al. |
| 6,596,296 | B1 | 7/2003 | Nelson et al. |
| 6,655,366 | B2 | 12/2003 | Sakai |
| 6,676,953 | B2 | 1/2004 | Hexamer |
| 6,676,960 | B2 | 1/2004 | Saito et al. |
| 6,685,956 | B2 | 2/2004 | Chu et al. |
| 6,685,957 | B1 | 2/2004 | Bezemer et al. |
| 6,689,374 | B2 | 2/2004 | Chu et al. |
| 6,695,992 | B2 | 2/2004 | Reneker |
| 6,712,610 | B2 | 3/2004 | Abdennour et al. |
| 6,716,449 | B2 | 4/2004 | Oshlack et al. |
| 6,737,447 | B1 | 5/2004 | Smith et al. |
| 6,753,454 | B1 | 6/2004 | Smith et al. |
| 6,821,479 | B1 | 11/2004 | Smith et al. |
| 6,855,366 | B2 | 2/2005 | Smith et al. |
| 6,858,222 | B2 | 2/2005 | Nelson et al. |
| 6,861,142 | B1 | 3/2005 | Wilkie et al. |
| 6,861,570 | B1 | 3/2005 | Flick |
| 6,913,760 | B2 | 7/2005 | Carr et al. |
| 7,029,495 | B2 | 4/2006 | Stinson |
| 7,033,603 | B2 | 4/2006 | Nelson et al. |
| 7,033,605 | B2 | 4/2006 | Wong |
| 7,048,913 | B2 | 5/2006 | Hexamer |
| 7,048,946 | B1 | 5/2006 | Wong et al. |
| 7,074,392 | B1 | 7/2006 | Friedman et al. |
| 7,135,194 | B2 | 11/2006 | Birnbaum |
| 7,172,765 | B2 | 2/2007 | Chu et al. |
| 7,198,794 | B1 | 4/2007 | Riley |
| 7,214,506 | B2 | 5/2007 | Tatsumi et al. |
| 7,235,295 | B2 | 6/2007 | Laurencin et al. |
| 7,285,266 | B2 | 10/2007 | Vournakis et al. |
| 7,309,498 | B2 | 12/2007 | Belenkaya et al. |
| 7,323,190 | B2 | 1/2008 | Chu et al. |
| 7,462,362 | B2 | 12/2008 | Kepka et al. |
| 7,678,366 | B2 | 3/2010 | Friedman et al. |
| 7,737,060 | B2 | 6/2010 | Strickler et al. |
| 7,765,647 | B2 | 8/2010 | Smith et al. |
| 7,799,965 | B2 | 9/2010 | Patel et al. |
| 7,803,395 | B2 | 9/2010 | Datta et al. |
| 7,824,699 | B2 | 11/2010 | Ralph et al. |
| 7,959,616 | B2 | 6/2011 | Choi et al. |
| 7,959,848 | B2 | 6/2011 | Reneker et al. |
| 7,959,904 | B2 | 6/2011 | Repka |
| 7,997,054 | B2 | 8/2011 | Bertsch et al. |
| 8,257,614 | B2 | 9/2012 | Gu et al. |
| 2001/0021873 | A1 | 9/2001 | Stinson |
| 2002/0176893 | A1 | 11/2002 | Wironen et al. |
| 2003/0017208 | A1 | 1/2003 | Ignatious et al. |
| 2003/0068353 | A1 | 4/2003 | Chen et al. |
| 2003/0118649 | A1 | 6/2003 | Gao et al. |
| 2003/0195611 | A1 | 10/2003 | Greenhalgh et al. |
| 2004/0030377 | A1 | 2/2004 | Dubson et al. |
| 2004/0076661 | A1 | 4/2004 | Chu et al. |
| 2004/0267362 | A1 | 12/2004 | Hwang et al. |
| 2005/0033163 | A1 | 2/2005 | Duchon et al. |
| 2005/0042293 | A1 | 2/2005 | Jackson et al. |
| 2005/0106211 | A1 | 5/2005 | Nelson et al. |
| 2005/0276841 | A1 | 12/2005 | Davis et al. |
| 2006/0024350 | A1 | 2/2006 | Varner et al. |
| 2006/0153815 | A1 | 7/2006 | Seyda et al. |
| 2006/0293743 | A1 | 12/2006 | Andersen et al. |
| 2007/0087027 | A1 | 4/2007 | Greenhalgh et al. |
| 2007/0155273 | A1 | 7/2007 | Chu et al. |
| 2007/0232169 | A1 | 10/2007 | Strickler et al. |
| 2007/0293297 | A1 | 12/2007 | Schugar |
| 2008/0053891 | A1 | 3/2008 | Koops et al. |
| 2008/0281350 | A1 | 11/2008 | Sepetka et al. |
| 2009/0155326 | A1 | 6/2009 | Mack et al. |
| 2009/0196905 | A1 | 8/2009 | Spada et al. |
| 2010/0184530 | A1 | 7/2010 | Johnson |
| 2010/0249913 | A1 | 9/2010 | Datta et al. |
| 2010/0291182 | A1 | 11/2010 | Palasis et al. |
| 2010/0318108 | A1 | 12/2010 | Datta et al. |

FOREIGN PATENT DOCUMENTS

| | | | |
|---|---|---|---|
| WO | WO-01/32229 | A1 | 5/2001 |
| WO | WO-03/020161 | A2 | 3/2003 |
| WO | WO-2007/052042 | A2 | 5/2007 |
| WO | WO-2008/013713 | A2 | 1/2008 |
| WO | WO-2008/085199 | A2 | 7/2008 |

OTHER PUBLICATIONS

Biomedical Structures, Glossary: Common Biomedical Textile Terms (accessed Oct. 12, 2011), 1-11 pgs.

Cui, W. et al., "Electrospun fibers of acid-labile biodegradable polymers with acetal groups as potential drug carriers", International Journal of Pharmaceutics, vol. 361 (1-2), pp. 47-55, (2008).

Gyeong-Man, Kim et al., "Electrospun PVA/HAp nanocomposite nanofibers: biomimetics of mineralized hard tissues at lower level of complexity", Bioinspiration & Biomimetics, vol. 3(4), pp. 1-12, (2008).

Huang, Zheng-Ming et al., "A review on polymer nanofibers and electrospinning and their applications in nanocomposites", Composites Science and Technology, 63:2223-2253, (2003).

Jose, Moncy V. et al., "Fabrication and characterization of aligned nanofibrous FLGA/Collagen blends as bone tissue scaffolds", Polymer, 50:3778-3785, (2009).

Kanani et al., "Review on Electrospul Nanofibers Scaffold and Biomedical Applications", Trends Biomater. Artif. Organs, vol. 24(2), 93-115, (2010).

Kim, Chan et al., "Characteristics of supercapaitor electrodes of PBI-based carbon nanofiber web prepared by electrospinning", Electrochimica Acta 50:877-881, (2004).

Kostakova, Eva et al., "Composite nanofibers produced by modified needleless electrospinning", Materials Letters, 63:2419-2422, (2009).

Li, Wan-Ju, et al., "Biological response of chondrocytes cultured in three-dimensional nanofibrous poly(?-caprolactone) scaffolds" Journal of Biomed Mater Research, 67:1105-1114, (2003).

Liao, Yiliang et al., "Preparation, characterization, and encapsulation/release studies of a composite nanofiber mat electrospun from an emulsion containing poly(lactic-co-glycolic acid)", Polymer, 49:5294-5299, (2008).

Liang, Dehai et al., "Functional electrospun nanofibrous scaffolds for biomedical applications" Advanced Drug Delivery Reviews 59:1392-1412, (2007).

Liu, Shih-Jung et al. "Electrospun PLGA/collagen nanofibrous membrane as early-stage would dressing" Journal of Membrane Science, 355:53-59, (2010).

Lowery, Joseph L. et al., "Effect of fiber diameter, pore size and seeding method on growth of human dermal fibroblasts in electrospun poly(ϵ-caprolactone) fibrous mats" Biomaterials, 31:491-504, (2010).

Lukas, David, et al., "Self-organization of jets in electrospinning from free liquid surface: A generalized approach", Journa lof Applied Physics, 103, 084309, (2008).

McCann, Jesse T. et al., "Electrospinning of nanofibers with core-sheath, hollow, or porous structures", Journal of Materials Chemistry, 15:735-738, (2005).

Park, Jeong-Ho et al., "Coaxial electrospinning of self-healing coatings" Advanced Materials 22:496-499, (2010).

Petrik, Stanislav et al., "Production nozzle-less electrospinning nanofiber technology" V Horkach 76/18, CZ-46007.

(56) References Cited

OTHER PUBLICATIONS

Pham, Quynh P. et al., "Electrospun poly(ϵ-caprolactone) microfiber and multilayer nanofiber/microfiber scaffolds: characterization of scaffolds and measurement of cellular infiltration", Biomacromolecules, 7:2796-2805, (2006).
Ren, Guanglei, et al., "Electrospun poly(vinyl alcohol)/glucose oxidase biocomposite membranes for biosensor applications" Reactive & Functional Polymers, 66:1559-1564, (2006).
Reneker, Darrell H. et al., "Nanometre diameter fibres of polymer, produced by electrospinning", Nanotechnology, 7:216-223, (1996).
Rhee et al, "Treatment of type II endoleaks with a novel polyurethane thrombogenic foam; Induction of endoleak thrombosis and elimination of intra-aneurysmal pressure in the canine model" Journal of Vascular Studies, 42:2, 321-328, (2005).
Rutledge, Gregory C., et al., "Formation of fibers by electrospinning", Advanced Drug Delivery Reviews, 59:1384-1391, (2007).
Sawicka, Katarzyna M. et al., "Electrospun composite nanofibers for functional applications", Journal of Nanoparticle Research, 8:769-781, (2006).
Sell, S.A., et al., "Electrospun polydioxanone-elastin blends: potential for bioresorbable vascular grafts" Biomedical Materials, 72-80, (2006).
Sy, Jay C. et al., "Emulsion as a Means of Controlling Electrospinning of Polymers", Advanced Materials, 21, 2009, 1814-1819.
Tan, Songting, et al., "Mini-review some fascinating phenomena in electrospinning processes and applications of electrospun nanofibers" Polymer International 56:1330-1339, (2007).
Theron, S.A. et al., "Multiple jets in electrospinning: experiment and modeling" Polymer, 46:2889-2899, (2005).
Varabhas, J.S., et al., "Electrospun nanofibers from a porous hollow tube" Polymer, 49:4226-4229, (2008).
Vonch, J. et al., "Electrospinning: A study in the formation of nanofibers", Journal of Undergraduate Research 1, 1, (2007).
Wang, Miao, et al., "Electrospinning of silica nanochannels for single moleculre detection", Applied Physics Letters, 88, 033106, (2006).
Wang, Xin, et al., "Needless electrospinning of nanofibers wtih a conical wire coil" Polymer Engineering and Science, 1583-1586 (2009).
Wei, Kai et al., "Emulsion Electrospinning of a Collegen-like Protein/PLGA Fibrous Scaffold: Empirical Modeling and Preliminary Release Assessment of Encapsulated Protein", Macromolecular Bioscience, 11:1526-1536, (2011).
Wu, Dezhi et al., "High throughput tip-less electrospinning via a circular cylindrical electrode", Journal of Nanoscience and Nanotechnology, 10:1-6, (2010).
Wutticharoenmongkol, Patcharaporn et al. "Preparation and characterization of novel bone scaffolds based on electrospun polycaprolactone fibers", Macromolecular Bioscience, vol. 6(1), pp. 70-77, (2006).
Xu, X. et al. "BCNU-loaded PEG-PLLA ultrafine fibers and their in vitro antitumor activity against Glima C6 cells", Journal of Controlled Release, vol. 114(3), pp. 307-316, (2006).
International Search Report mailed Jan. 18, 2011 for International Application No. PCT/US2010/057010 (3pgs).
International Search Report mailed Jan. 9, 2011 for International Application No. PCT/US2011/44448 1pg).
International Search Report mailed Dec. 7, 2012 for International Application No. PCT/US12/0555361.

ELECTROSPINNING PROCESS FOR MANUFACTURE OF MULTI-LAYERED STRUCTURES

This invention was made with Government support under 70NANB11H004 awarded by the National Institute of Standards and Technology (NIST). The Government has certain rights in the invention.

CROSS REFERENCE TO RELATED APPLICATIONS

The present invention claims priority to U.S. application Ser. No. 13/362,467 entitled "Electrospinning Process for Manufacture of Multi-Layered Structures," filed Jan. 31, 2012.

FIELD OF THE INVENTION

The present invention generally relates to fiber structures and methods of forming fiber structures using wedge-shaped vessels.

BACKGROUND

Macro-scale structures formed from concentrically-layered nanoscale or microscale fibers ("core-sheath fibers") are useful in a wide range of applications including drug delivery, tissue engineering, nanoscale sensors, self-healing coatings, and filters. On a commercial scale, the most commonly used techniques for manufacturing core-sheath fibers are extrusion, fiber spinning, melt blowing, and thermal drawing. None of these methods, however, are ideally suited to producing drug-loaded core-sheath fibers, as they all utilize high temperatures which may be incompatible with thermally labile materials such as drugs or polypeptides. Additionally, fiber spinning, extrusion and melt-blowing are most useful in the production of fibers with diameters greater than ten microns.

Core-sheath fibers can be produced by electrospinning, in which an electrostatic force is applied to a polymer solution to form very fine fibers. Conventional electrospinning methods utilize a charged needle to supply a polymer solution, which is then ejected in a continuous stream toward a grounded collector. After removal of solvents by evaporation, a single long polymer fiber is produced. Core-sheath fibers have been produced using emulsion-based electrospinning methods, which exploit surface energy to produce core-sheath fibers, but which are limited by the relatively small number of polymer mixtures that will emulsify, stratify, and electrospin. Core-sheath fibers have also been produced using coaxial electrospinning, in which concentric needles are used to eject different polymer solutions: the innermost needle ejects a solution of the core polymer, while the outer needle ejects a solution of the sheath polymer. This method is particularly useful for fabrication of core-sheath fibers for drug delivery in which the drug-containing layer is confined to the center of the fiber and is surrounded by a drug-free layer. However, both emulsion and coaxial electrospinning methods can have relatively low throughput, and are not ideally suited to large-scale production of core-sheath fibers. To increase throughput, coaxial nozzle arrays have been utilized, but such arrays pose their own challenges, as separate nozzles may require separate pumps, the multiple nozzles may clog, and interactions between nozzles may lead to heterogeneity among the fibers collected. Another means of increasing throughput, which utilizes a spinning drum immersed in a bath of polymer solution, has been developed by the University of Liberec and commercialized by Elmarco, S.R.O. under the mark Nanospider®. The Nanospider® improves throughput relative to other electrospinning methods, but it is not currently possible to manufacture core-sheath fibers using the Nanospider®. There is, accordingly, a need for a mechanically simple, high-throughput means of manufacturing core-sheath fibers.

SUMMARY OF THE INVENTION

The present invention addresses the need described above by providing systems and methods for high-throughput production of core-sheath fibers.

In one aspect the present invention relates to an apparatus used for the electrospinning of core-sheath structures such as fibers. The apparatus comprises first and second wedge-shaped vessels, each having a slit at an apex. The first vessel is disposed inside of the second vessel such that each of the slits of the vessels is aligned. The apparatus includes means for applying a voltage source to one or more materials contained within fluid reservoirs that are in fluid communication with the wedge-shaped vessels. The apparatus also includes means for pumping fluid from one or both of the reservoirs to the wedge-shaped vessels.

Another aspect the present invention relates to a method of forming a structure comprising a core including a first material and a sheath including a second material around said core. The method comprises the steps of providing an apparatus comprising first and second wedge-shaped vessels, each having a slit at an apex thereof where the first vessel is disposed inside of the second vessel such that the first and second slits are aligned. The method further comprises the step of introducing first and second materials, at least one of which is electrically conductive, into the first and second wedge-shaped vessels. The method further comprises the step of applying a voltage of between 1 and 100 kV to at least one of the first and second materials, and pumping the first and second fluids from the fluid reservoirs to the wedge-shaped vessels.

BRIEF DESCRIPTION OF THE DRAWINGS

In the drawings, like reference characters generally refer to the same parts throughout the different views. Drawings are not necessarily to scale, as emphasis is placed on illustration of the principles of the invention.

DETAILED DESCRIPTION OF THE PREFERRED EMBODIMENTS

Figure 1:
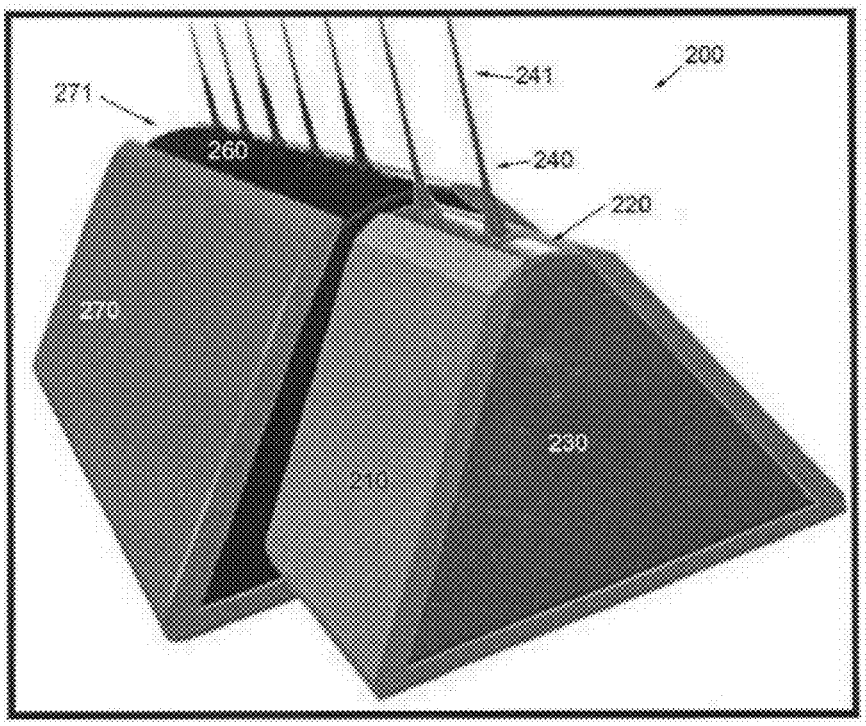
FIG. 1 is a schematic illustration of a portion of an electrospinning apparatus according to an embodiment of the invention.

The present invention relates to electrospun fibers, including drug-containing electrospun fibers, that are produced in a high yield manner. The fibers are formed into a core-sheath configuration, such that in cross section, the fiber includes a central core as an inner radial portion surrounded by a sheath having an outer radial portion, as is known in the art. Fibers of the present invention preferably have a total diameter of no more than about 20 microns.

Examples of biodegradable polymers that can be used with the present invention to form the core and/or sheath portions of a fiber include: polyesters, such as poly(ϵ-caprolactone), polyglycolic acid, poly(L-lactic acid), poly(DL-lactic acid); copolymers thereof such as poly(lactide-co-ϵ-caprolactone), poly(glycolide-co-ϵ-caprolactone), poly(lactide-co-glycolide), copolymers with polyethylene glycol (PEG); branched polyesters, such as poly(glycerol sebacate); polypropylene fumarate); poly(ether esters) such as polydioxanone; poly(ortho esters); polyanhydrides such as poly (sebacic anhydride); polycarbonates such as poly(trimethylcarbonate) and related copolymers; polyhydroxyalkanoates such as 3-hydroxybutyrate, 3-hydroxyvalerate and related copolymers that may or may not be biologically derived; polyphosphazenes; poly(amino acids) such as poly (L-lysine), poly (glutamic acid) and related copolymers. Examples of other dissolvable or resorbable polymers include polyethylene glycol and poly(ethylene glycol-propylene glycol) copolymers that are known as pluronics and reverse pluronics.

Examples of biologically derived restorable polymers that can be used with the present invention include: polypeptides such as collagen, elastin, albumin and gelatin; glycosaminoglycans such as hyaluronic acid, chondroitin sulfate, dermatan sulfate, keratan sulfate, heparan sulfate and heparin; chitosan and chitin; agarose; wheat gluten; polysaccharides such as starch, cellulose, pectin, dextran and dextran sulfate; and modified polysaccharides such as carboxymethylcellulose and cellulose acetate.

Examples of non-biodegradable polymers that can be used with the present invention include: nylon 4, 6; nylon 6; nylon 6,6; nylon 12; polyacrylic acid; polyacrylonitrile; poly(benzimidazole) (PBI); poly(etherimide) (PEI); poly(ethylenimine); poly(ethylene terephthalate); polystyrene; poly(styrene-block-isobutylene-block-styrene); polysulfone; polyurethane; polyurethane urea; polyvinyl alcohol; poly(N-vinylcarbazole); polyvinyl chloride; poly (vinyl pyrrolidone); poly(vinylidene fluoride); poly(tetrafluoroethylene) (PTFE); polysiloxanes; and poly (methyl methacrylate).

Electrospun core-sheath fibers and other structures produced by the systems and methods of the invention may optionally include any suitable drug, compound, adjuvant, etc. and may be used for any indication that may occur to one skilled in the art. In preferred embodiments, the drug or other material chosen is insoluble in the polymers and solvents comprising the core polymer solution, or the concentration of drug or material used exceeds the solubility limit of the drug or material in the polymers or solvents. Without limiting the foregoing, general categories of drugs that are useful include, but are not limited to: opioids; ACE inhibitors; adenohypophoseal hormones; adrenergic neuron blocking agents; adrenocortical steroids; inhibitors of the biosynthesis of adrenocortical steroids; alpha-adrenergic agonists; alpha-adrenergic antagonists; selective alpha-two-adrenergic agonists; androgens; anti-addictive agents; antiandrogens; anti-infectives, such as antibiotics, antimicrobals, and antiviral agents; analgesics and analgesic combinations; anorexics; antihelminthics; antiarthritics; antiasthmatic agents; anticonvulsants; antidepressants; antidiabetic agents; antidiarrheals; antiemetic and prokinetic agents; antiepileptic agents; antiestrogens; antifungal agents; antihistamines; antiinflammatory agents; antimigraine preparations; antimuscarinic agents; antinauseants; antineoplastics; antiparasitic agents; antiparkinsonism drugs; antiplatelet agents; antiprogestins; antipruritics; antipsychotics; antipyretics; antispasmodics; anticholinergics; antithyroid agents; antitussives; azaspirodecanediones; sympathomimetics; xanthine derivatives; cardiovascular preparations, including potassium and calcium channel blockers, alpha blockers, beta blockers, and antiarrhythmics; antihypertensives; diuretics and antidiuretics; vasodilators, including general coronary, peripheral, and cerebral; central nervous system stimulants; vasoconstrictors; hormones, such as estradiol and other steroids, including corticosteroids; hypnotics; immunosuppressives; muscle relaxants; parasympatholytics; psychostimulants; sedatives; tranquilizers; nicotine and acid addition salts thereof; benzodiazepines; barbiturates; benzothiadiazides; beta-adrenergic agonists; beta-adrenergic antagonists; selective beta-one-adrenergic antagonists; selective beta-two-adrenergic antagonists; bile salts; agents affecting volume and composition of body fluids; butyrophenones; agents affecting calcification; catecholamines; cholinergic agonists; cholinesterase reactivators; dermatological agents; diphenylbutylpiperidines; ergot alkaloids; ganglionic blocking agents; hydantoins; agents for control of gastric acidity and treatment of peptic ulcers; hematopoietic agents; histamines; 5-hydroxytryptamine antagonists; drugs for the treatment of hyperlipiproteinemia; laxatives; methylxanthines; monoamine oxidase inhibitors; neuromuscular blocking agents; organic nitrates; pancreatic enzymes; phenothiazines; prostaglandins; retinoids; agents for spasticity and acute muscle spasms; succinimides; thioxanthines; thrombolytic agents; thyroid agents; inhibitors of tubular transport of organic compounds; drugs affecting uterine motility; anti-vasculogenesis and angiogenesis; vitamins; and the like; or a combination thereof.

The invention includes means for co-localizing sheath and core polymer solutions at multiple sites of Taylor cone formation during an electrospinning process so that core-sheath fibers are produced. In certain embodiments, devices of the invention comprise a hollow vessel having a lengthwise slit therethrough, through which a solution of the core polymer can be introduced. Flow of both core and sheath polymer solutions is initiated and an electric field is introduced. These steps are performed in any suitable order: for example, in some embodiments, flow of the core polymer solution is initiated, a field is introduced and Taylor cones and electrospinning jets comprising core polymer solution are formed; then sheath polymer flow is initiated such that the sheath polymer is incorporated into Taylor cones and electrospinning jets. In other embodiments, the sheath polymer flow is initiated first, then the field is introduced and, after formation of Taylor cones and electrospinning jets, the core polymer flow is initiated. In still other embodiments, both polymer solutions are provided simultaneously, then the field is introduced, etc.

Figure 2:
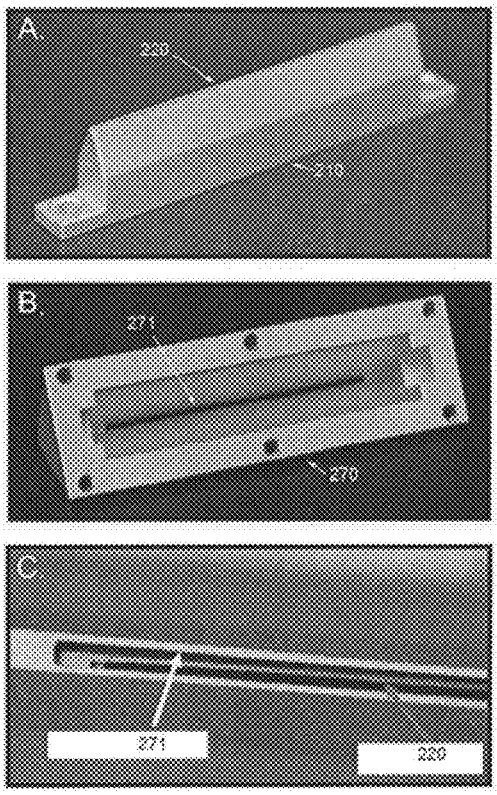
FIG. 2 includes photographs of portion of an electrospinning apparatus according to certain embodiments of the invention.
Figure 3:
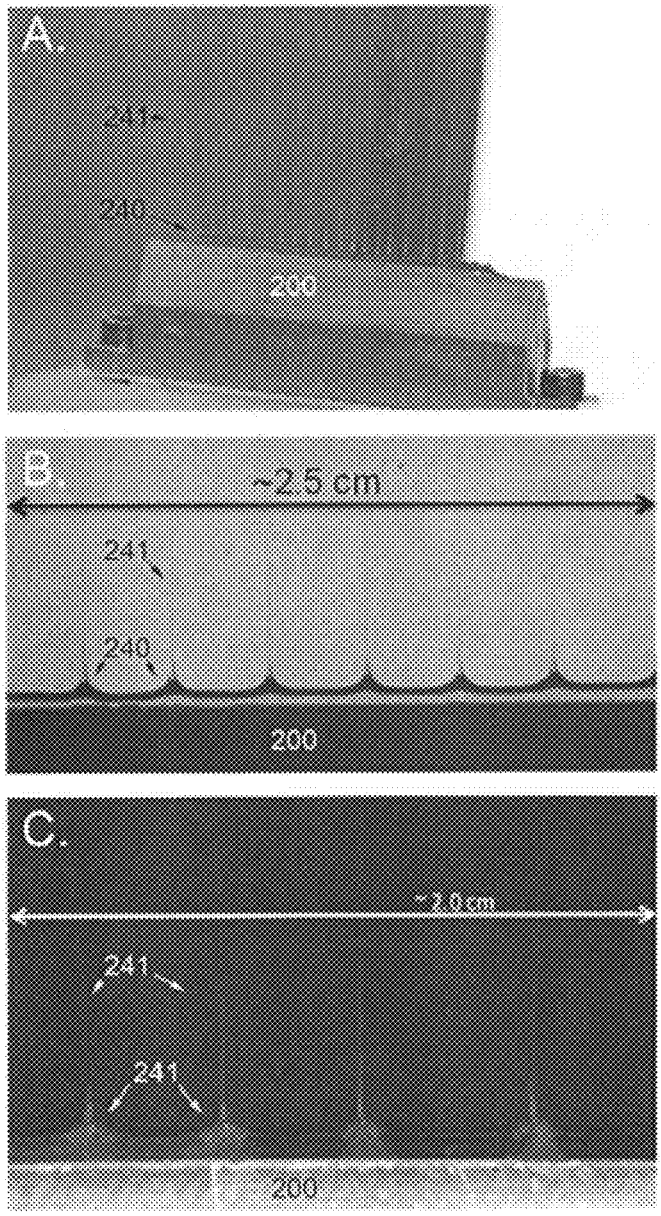
FIG. 3 includes photographs of electrospinning apparatus of the invention in use.
Figure 4:
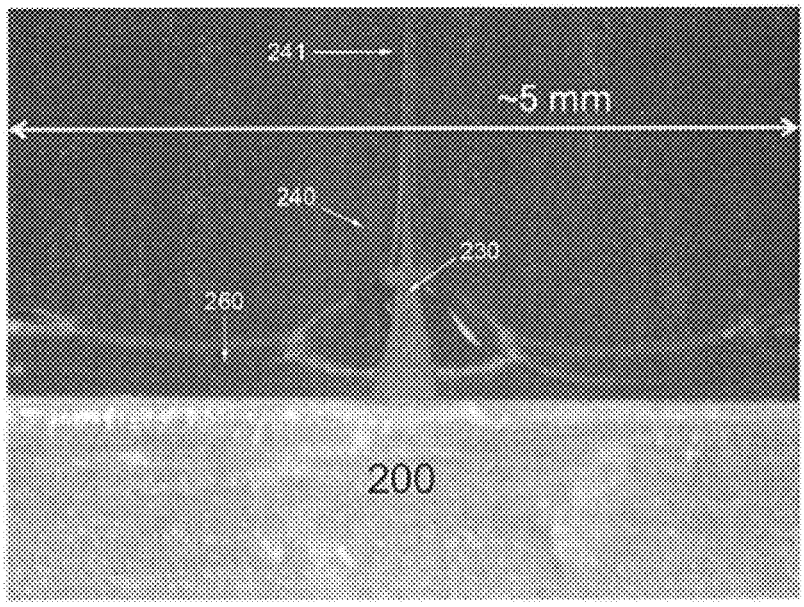
FIG. 4 is a close up photograph of a Taylor cone from an operating electrospinning apparatus of the invention.
Figure 18:
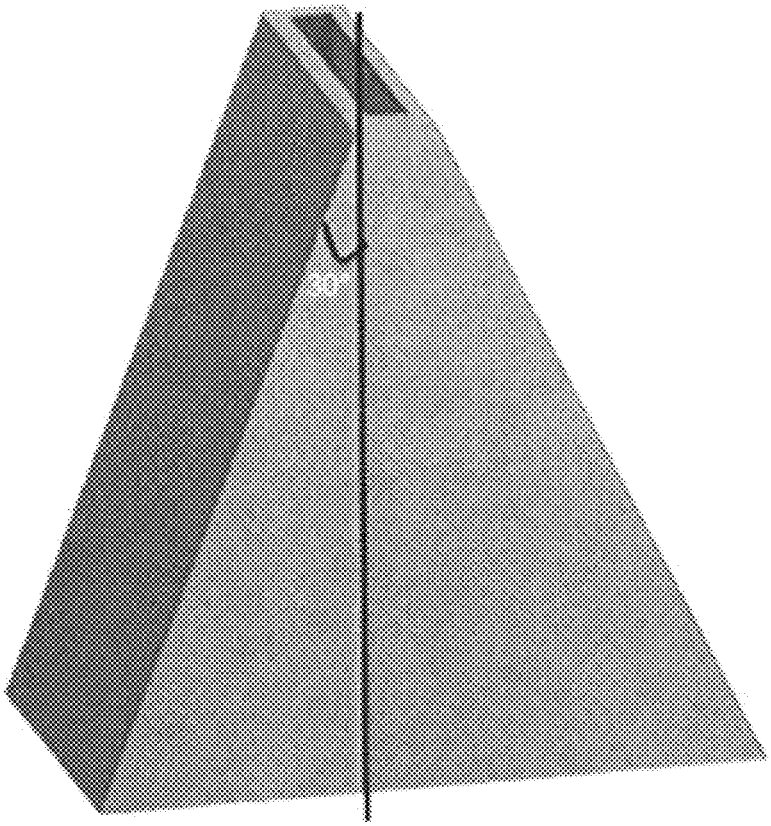
FIG. 18 includes a schematic depiction of an angle in a wedge-shaped vessel according to certain embodiments of the invention.

Application of an electric field of sufficient strength to apparatuses of the invention leads to formation of Taylor cones and electrospinning jets in the polymer solution or solutions. In some embodiments, Taylor cones and electrospinning jets are formed in the core polymer solution 230, then the sheath polymer solution 260 is added alongside or above the core polymer solution 230 so that the sheath polymer solution 260 is drawn up into Taylor cones 240 and electrospinning jets 241. In preferred embodiments, Taylor cones and jets are formed in the sheath polymer solution 260 and the core polymer solution 230 is added, preferably beneath the sheath polymer solution 260, so that it is incorporated or pulled into electrospinning jets. As illustrated in FIG. 1, this can be achieved, in preferred embodiments, by using an apparatus 200 comprising nested wedge-shaped vessels 210, 270 in which an inner vessel 210 is positioned within an outer vessel 270. A first slit 220 is located at one apex of the inner wedge shaped vessel; 210, and a second, larger wedge-shaped vessel 270 is arranged so that a second slit 271 is aligned with the first slit 220 and a gap exists between the inner wedge-shaped vessel 210 and the outer wedge-shaped vessel 270, permitting a solution of sheath polymer solution 260 to flow around the inner wedge shaped vessel 210. The wedge-shaped vessels 210, 270 may be oriented so that the slit is aligned with a vertical plumb line, or it may be angled with respect to a vertical plumb line so that extra core polymer solution 230 or extra sheath polymer solution 260 can run-off, preventing formation of inhomogeneities such as globs in the resulting fibers or other structures. The arrangement of the slit 271 of the bath 270 to the slit 220 of the inner vessel 210 is illustrated in FIG. 2, which shows the slit 271 substantially surrounding the slit 220. FIG. 3 shows multiple core-sheath Taylor cones 240 and electrospinning jets 241 emanating from the slit 270 when the apparatus is in use. A close-up image of a core-sheath Taylor cone is shown in FIG. 4. The wedge shaped vessels, in preferred embodiments, include side walls that are angled 30° from the vertical, as shown in FIG. 18.

The vessels 210, 270 are made of a conducting material such as stainless steel, copper, bronze, brass, gold, silver, platinum, and other metals and alloys. Slits 220, 271 preferably have a width sufficient to permit formation of Taylor cones 240, generally between 0.01 and 20 millimeters, and preferably between 0.1 to 5 millimeters. The length of vessels 210, 270 is preferably between 5 centimeters and 50 meters, and more preferably between 10 centimeters and 2 meters.

Metals used to form portions of apparatuses of the invention may be polished, brushed, cast, etched (by acid or other chemical or mechanically) or unfinished. The metal finish may be chosen to affect an aspect of the performance of the apparatus; for example, the inventors have found that using polished brass improves the flow of polymer solution. Alternatively, non-metal materials or insulating materials may be used to form all or a part of the components used within the apparatuses of the present invention.

The materials used to form the core and sheath portions of the fibers formed in the present invention are placed into solution before being introduced into the apparatuses that are used for fiber formation. The core polymer solution preferably has a viscosity of between 1 and 100,000 centipoise, and is preferably pumped through the inner vessel 210 at rates of between 0.01 and 1000 milliliters per hour per centimeter, more preferably between 5 and 200 milliliters per hour per centimeter. A voltage, preferably between 1 and 250 kV, more preferably between 20-100 kV, is applied. The positive electrode of the power supply is preferably connected to one or both of the vessels 210, 270 such that a potential exists between one or both of the vessels and a grounded collector that is placed at a distance. In alternate embodiments the collector is oppositely charged relative to the polymer solution(s). In some embodiments, the collector 250 includes one or more grounded or oppositely charged points (for example, two grounded points separated by a space), and fibers collect around the one or more points and/or between them. Upon application of a sufficient voltage, Taylor cones 240 and electrospinning jets 241 will form at the exposed surface of core and/or sheath polymer solution(s) 230, 260 and the jets will attract towards the collector.

In preferred embodiments, core and/or sheath polymer solutions 230, 260 are provided to the interior and exterior, respectively, of the vessel 210 at the slit 220 in a steady, laminar fashion such that fluid velocity and pressure of the core and/or sheath polymers 230, 260 are constant across the width of the slit 230 over time. Such steady, laminar flow can be achieved by a variety of methods, which may be used alone or combined, and the inventors have found that driving polymer flow pneumatically, hydraulically, mechanically (piston-driven) or by gravity can result in a suitably consistent supply of the required fluids; this aim can also be met by employing flow directing structures such as diffusers in flow paths for the core and sheath polymers 230, 260.

Figure 6:
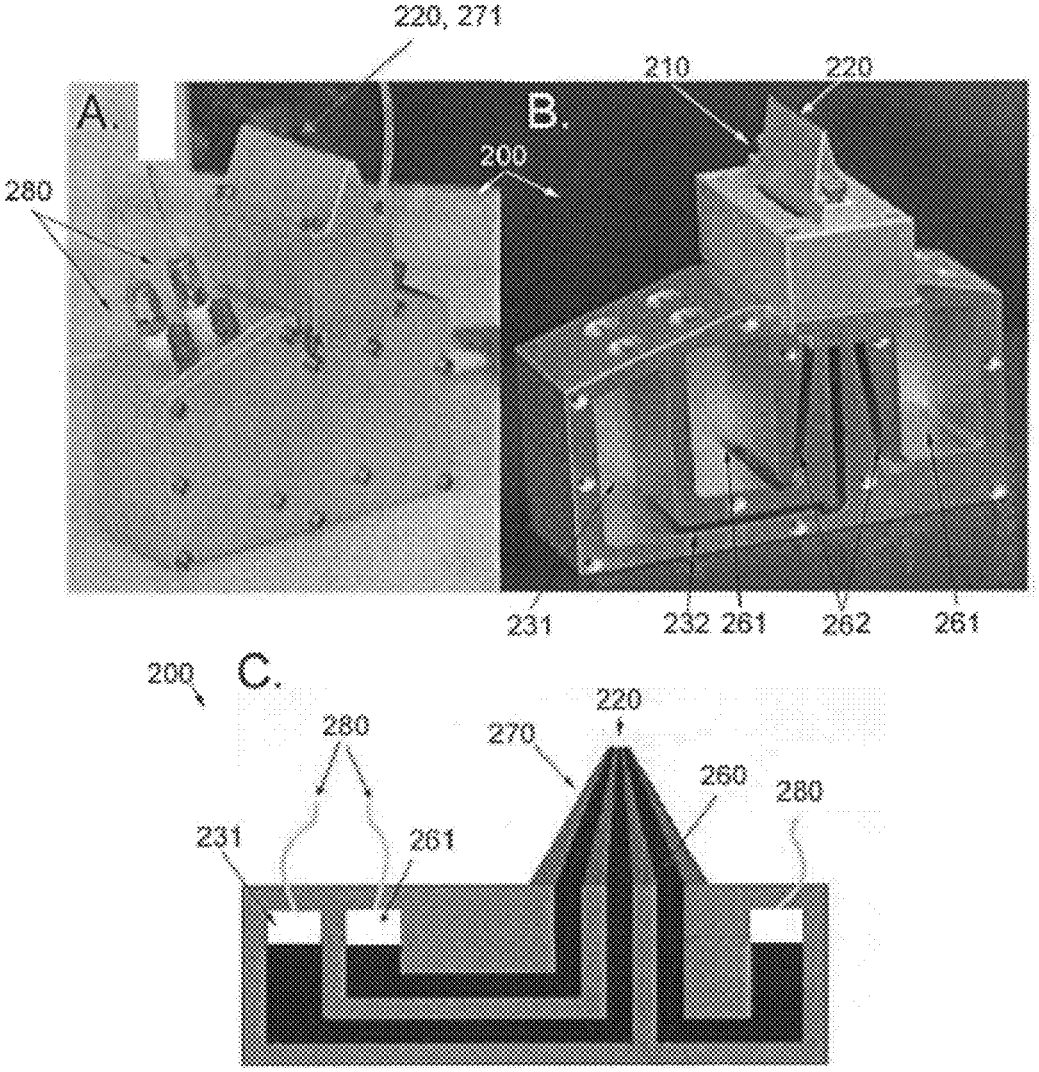
FIG. 6 includes photographs and schematic illustrations of apparatuses utilizing pneumatic fluid supplies according to certain embodiments of the invention.

With respect to pneumatic driving of fluids, FIG. 6 shows apparatuses of the invention utilizing reservoirs 231, 261 for core polymer solution 230 and sheath polymer solution 260, respectively. Each of the reservoirs includes one or more gas inputs 280, each of which preferably located opposite a conduit 232, 262 for the core and sheath polymer solutions 230, 260, respectively. For example, in the embodiments of FIG. 6, gas is provided via inputs 280 at the top of the reservoirs 231, 261, and polymer solutions exit via conduits 232, 262 at the bottom of the reservoirs. The conduits of the apparatus 200 preferably have a width that is roughly the same as a width of the slit 220, thus minimizing the formation of spreading flows and eddies that may result in variances of fluid velocity or pressure across the width of the slit 220. In some embodiments, turbulent and/or uneven flows are minimized by removing sharp angles or curves from the flow paths from the reservoirs 231, 261 through the conduits 232, 262 to the slit 220; the flow paths may be, in some embodiments, substantially linear. It will be appreciated that solutions can also be injected through the inputs 280 leading to reservoirs 231, 261 and 280 to permit continuous electrospinning.

Any suitable gas may be used to drive the flow of core and/or sheath fluids 230, 260, including air, but in preferred embodiments a non-reactive or inert gas is used such as nitrogen, helium, argon, krypton, xenon, carbon dioxide, helium, nitrous oxide, oxygen, combinations thereof and the like. The gas used to drive flows is optionally insoluble in the solvents used in the core or sheath polymer solutions 230, 260 to prevent the formation of gas bubbles during electrospinning. Additional steps may be taken to prevent bubble formation during electrospinning, including de-gassing the core and sheath polymer solutions 230, 260 prior to use and separating the gas used to drive fluid flows from the polymer solutions 230, 260 through the use of an impermeable membrane or piston. In some embodiments, an inflatable balloon is used to displace polymer solutions 230, 260 from the reservoirs 231, 261. The reservoirs 231, 261 and the gas inputs 280 are preferably sufficiently airtight to prevent leakage at the gas pressures used.

Figure 7:
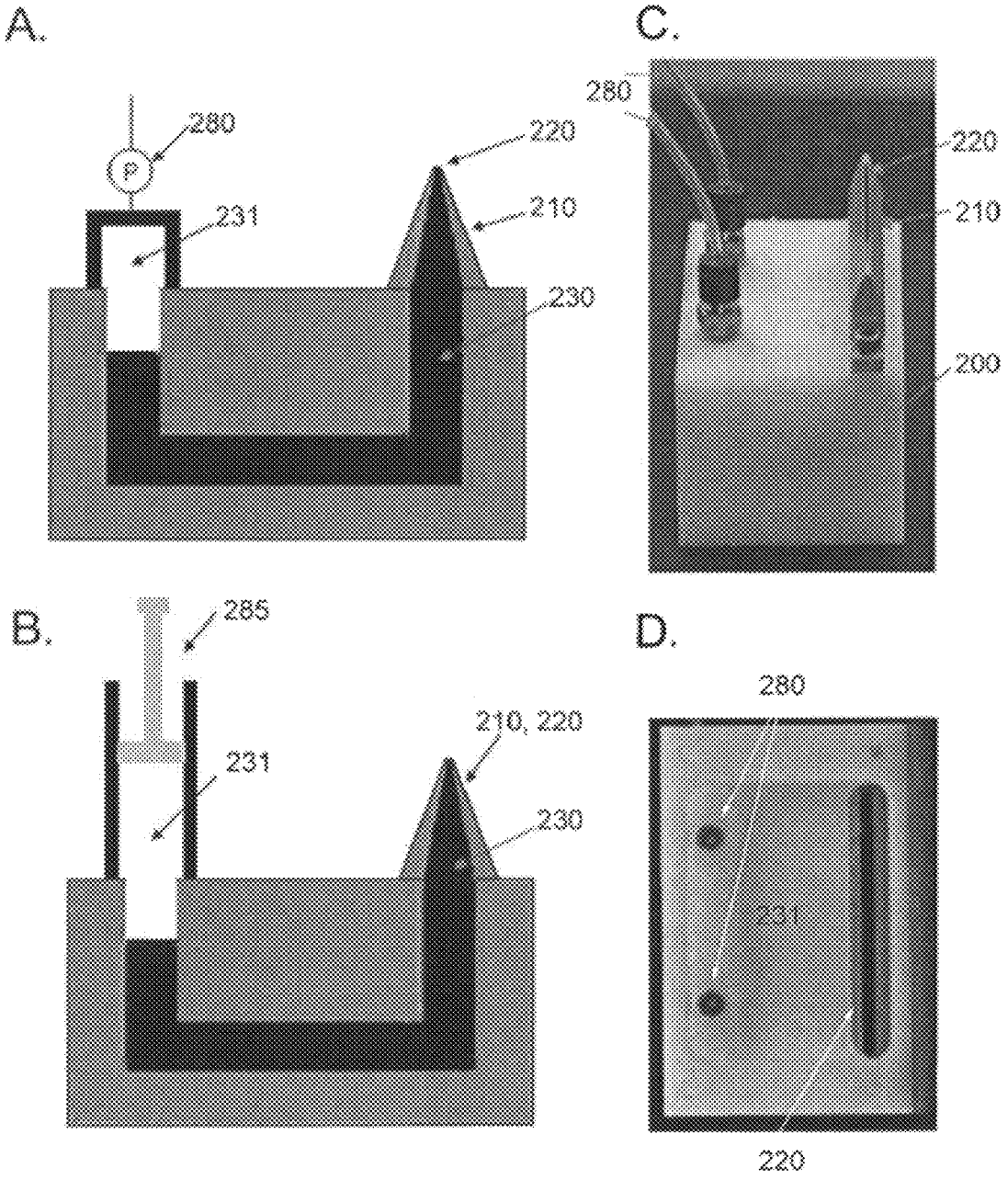
FIG. 7 includes schematic illustrations and photographs of apparatuses utilizing pneumatic fluid supplies according to certain embodiments of the invention.

As shown in FIG. 7, pneumatic driving mechanisms may include pressure regulators (FIG. 7A) to ensure that gas is provided at a constant pressure, which in turn will advantageously permit the maintenance of even fluid flows during electrospinning. In some embodiments, pneumatic pressure is generated through the use of a piston 285 to compress a fixed volume of gas in an airtight vessel such as a polymer solution reservoir. Finally as shown in FIG. 7C-D, in some embodiments, multiple air inlets 280 are used to ensure pneumatic pressure is applied evenly across the width of the reservoir 231/261 and, in turn, that the fluid velocity and pressure is kept even across the width of the slit 220.

Figure 8:
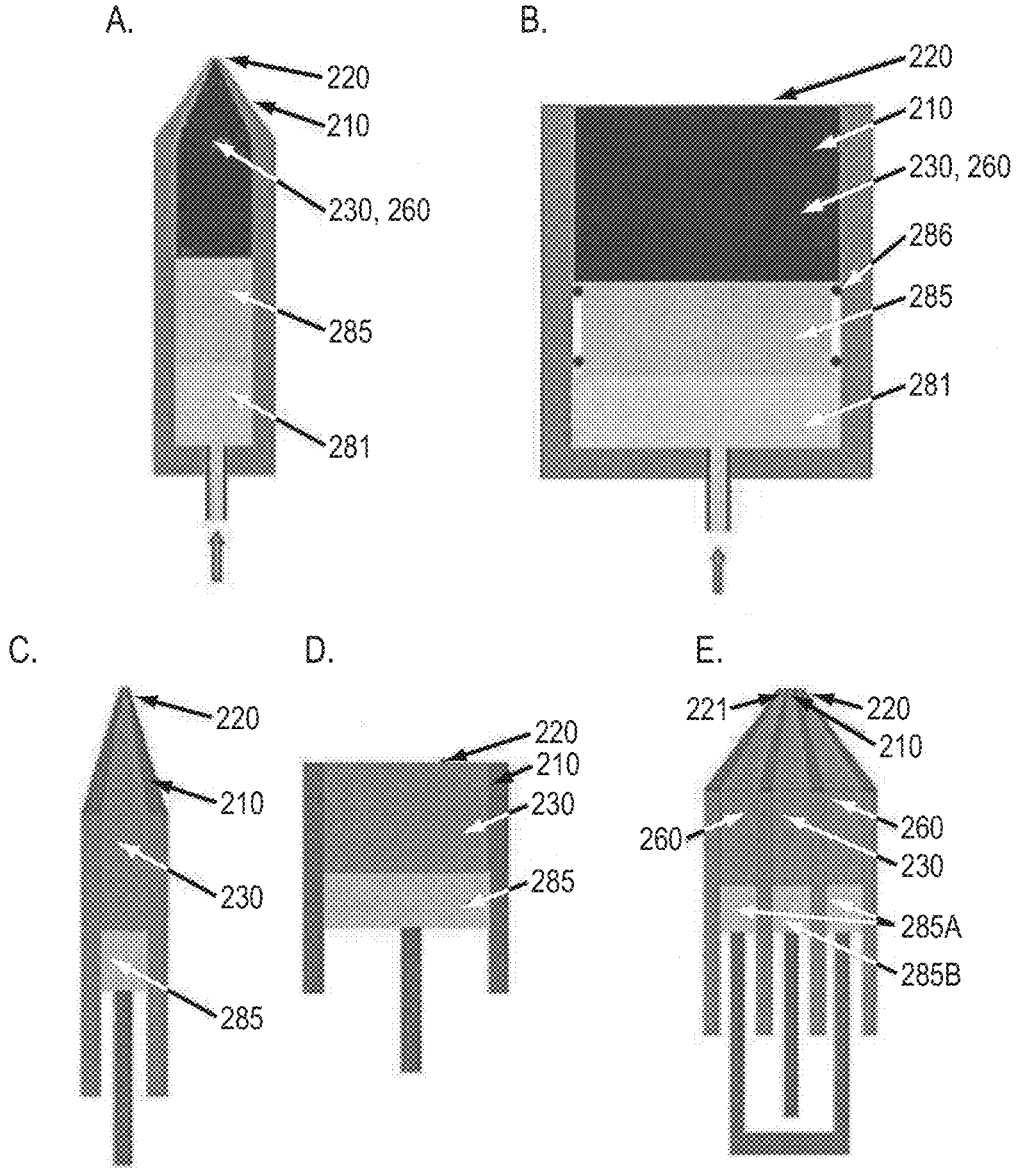
FIG. 8 includes schematic illustrations of hydraulically-driven and mechanically-driven fluid supplies according to certain embodiments of the invention.
Figure 9:
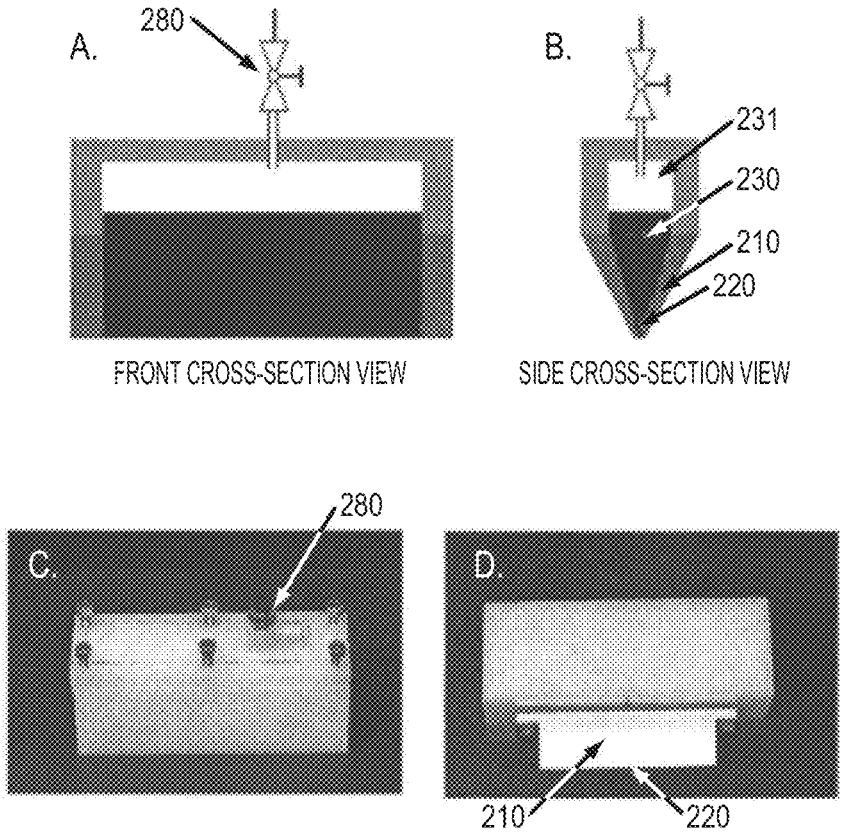
FIG. 9 includes photographs and schematic illustrations of gravity-driven fluid supplies according to certain embodiments of the invention.

With respect to hydraulic driving of fluids, as shown in FIG. 8 A-B, in preferred embodiments a fluid 281 such as water will be used to displace a piston 285 which then displaces a polymer solution such as the core polymer solution 230 toward the slit 220. As discussed above, the piston 285 preferably moves through a reservoir or a conduit having a width approximately equal to a width of the slit 220, and the piston 285 itself preferably has a width substantially equal to the width of the slit 220. Also as discussed above, an inlet for the fluid 281 and the piston 285 can be disposed within a reservoir opposite a conduit, or in any other suitable arrangement.

In some embodiments, the piston includes one or more sealing features 286 such as gaskets or O-rings to prevent the driving fluid from mingling with the polymer solution. This aim may also be achieved in some embodiments by tailoring the surfaces of the piston 285 and/or the reservoir to repel the fluid 281 used to drive the piston 285—for example, in embodiments where water is used to drive the piston 285, the piston and the wall of the reservoir may include hydrophobic surfaces to prevent the migration of water past the piston.

With respect to piston-driven fluids, piston 285 may be made of any suitable material, including plastics, metals and combinations thereof. In some embodiments, the piston 285 is made of a material that is the same as or similar to a material included in the vessel 210; in other embodiments, the piston is non-conductive and/or includes a dielectric material. The piston preferably includes a material that is non-reactive with the polymer solutions 230, 260. The piston and/or the reservoir may include a coating or surface to render it non-reactive and/or to prevent a gas or liquid used to drive the piston from mingling with the polymer solution. The piston and/or the reservoir may also include a coating to minimize friction between the piston and the walls of the reservoir to prevent binding between the piston to the walls and variation in fluid velocities and pressures delivered to the slit 220.

Pistons may be driven pneumatically, hydraulically (as discussed above) or by mechanical actuators such as screw actuators or linear actuators. Multiple pistons may be used to drive core polymer solution 230 and sheath polymer solution 260. As shown in FIG. 8E, in some embodiments, sheath polymer solution is driven by multiple pistons 285A which are coupled to one-another to ensure the supply of sheath polymer solution is consistent on either side of the slit 220.

Figure 11:
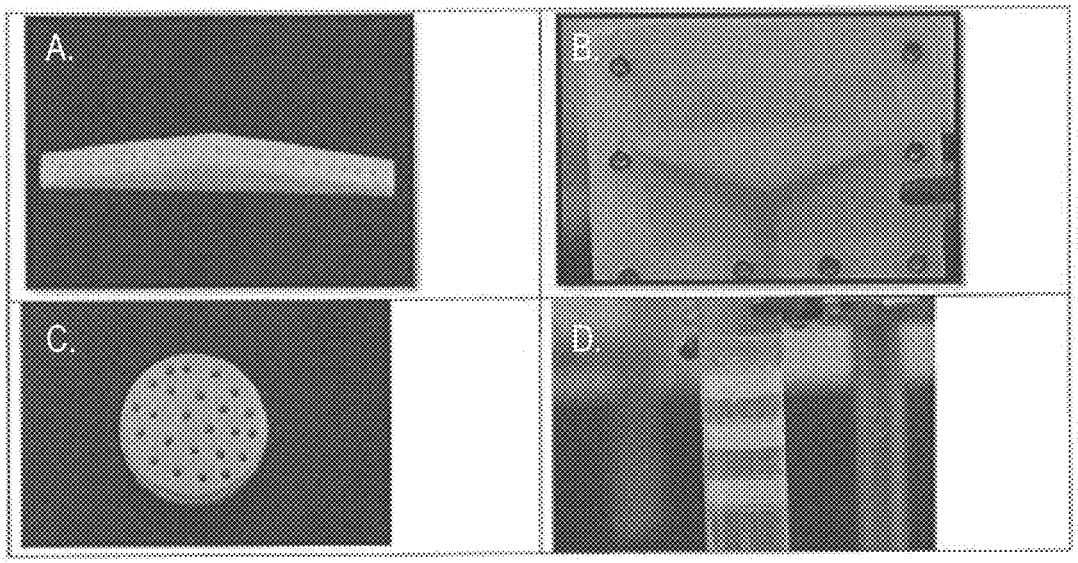
FIG. 11 includes photographs of diffusers in accordance with the invention.
Figure 12:
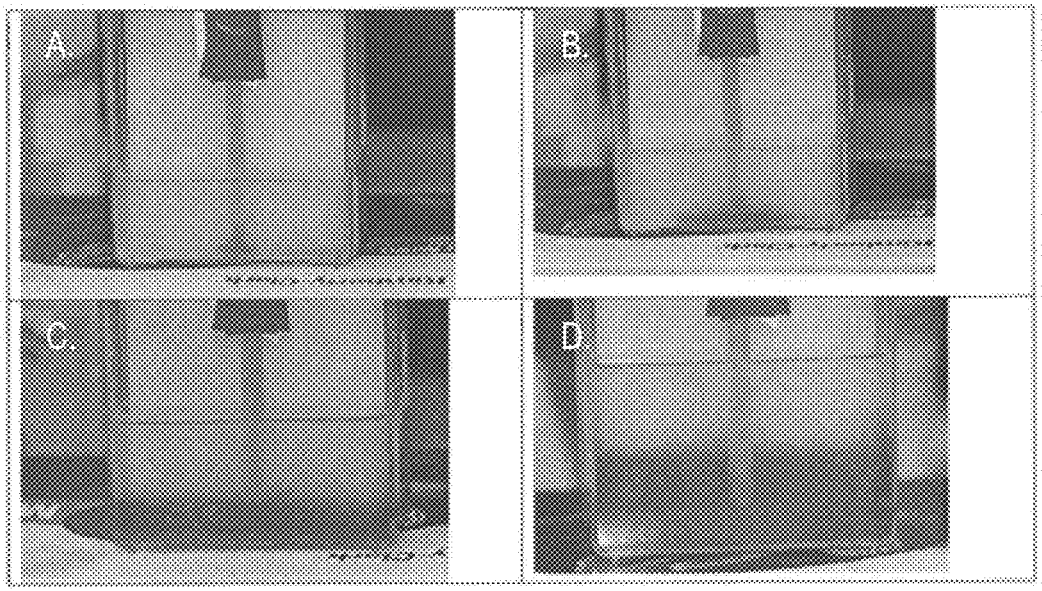
FIG. 12 includes photographs of even polymer solution flows achieved with a change of the direction of flow in accordance with certain embodiments of the invention.

Pressure diffusers can be used to even out flow across a vessel and/or a slit for electrospinning Pressure diffusers, as the term is used herein, refers to structures that obstruct at least a portion of a flow path to re-direct a relatively narrow stream of fluid over a larger area. A pressure diffuser may include holes, slits, or other apertures to permit fluid to flow through the diffuser. A diffuser may also include angled, curved, or beveled surfaces to force fluid contacting such surfaces to flow in desired directions around the diffuser. One or more diffusers can be arranged, in parallel or in series, across a flow path to more fully diffuse the flow of a solution. The diffuser can include surfaces parallel to, perpendicular to, or otherwise angled to a desired direction of flow. A selection of diffusers compatible with the invention are illustrated in FIG. 11.

With respect to gravity-driven fluid flows, in such embodiments, a reservoir such as a core polymer solution reservoir 231 will be positioned above the hollow vessel 210 and the slit 220, such that the polymer solution 230/260 will flow downward by gravity from the reservoir toward the slit. The apparatus 200 includes a vent or valve through which air can enter the reservoir 231/261 to occupy space vacated by polymer solution 230/260 as it flows toward the slit 220.

In some embodiments, the polymers used in the present invention include additives such as drug particles, metallic or ceramic particles to yield fibers having a composite structure.

Figure 13:
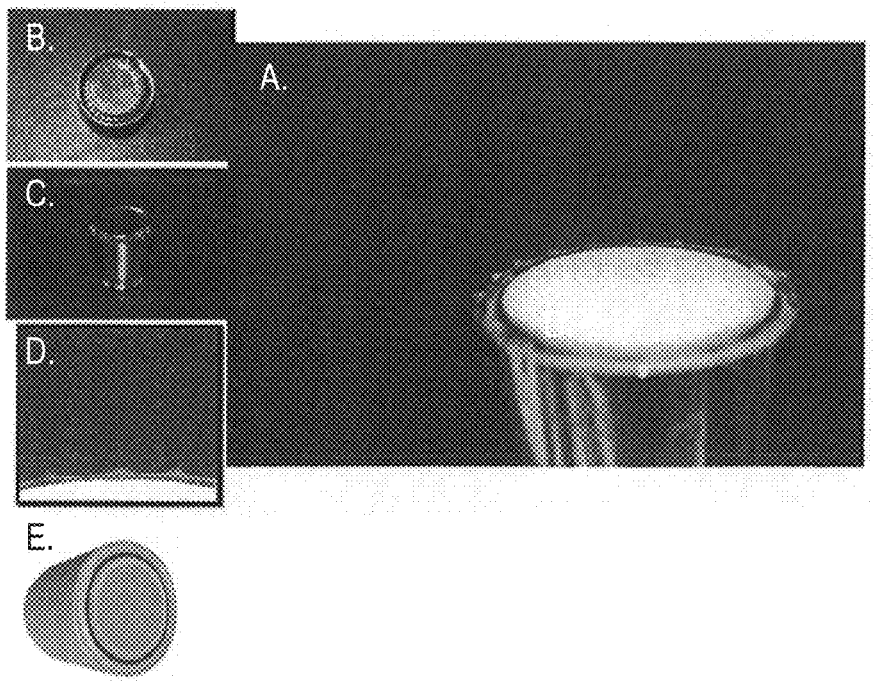
FIG. 13 includes photographs and schematic drawings of an electrospinning apparatus of the invention having a circular slit.
Figure 14:
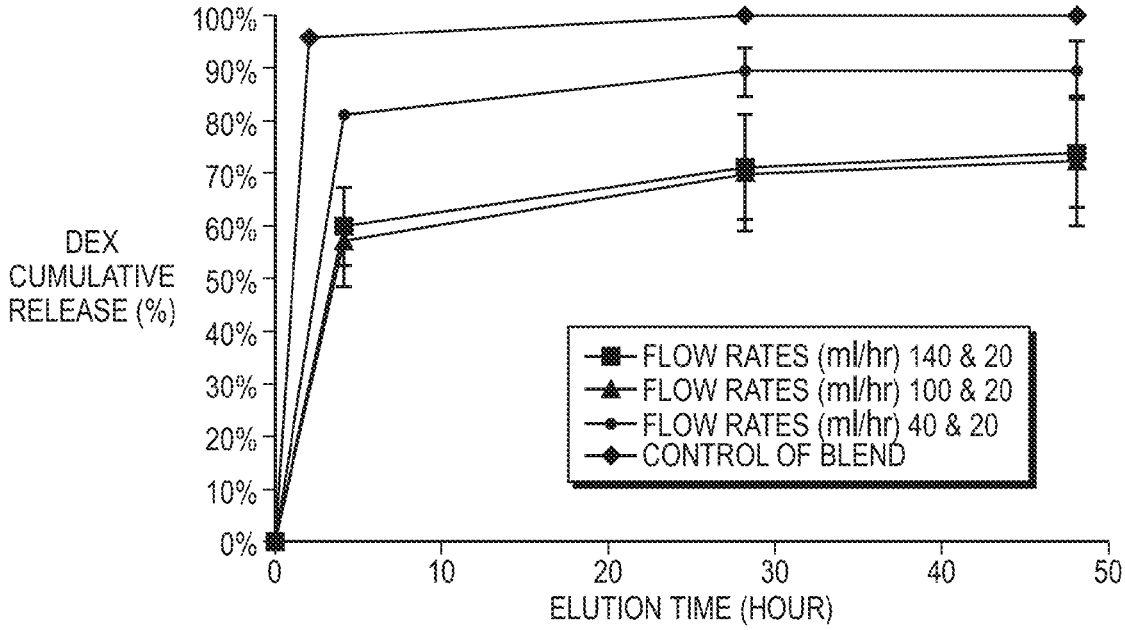
FIG. 14 includes cumulative dexamethasone release data from core-sheath fibers formed under varying flows of sheath polymer solution.

Other suitable vessel geometries may be used in accordance with the present invention, including round designs as shown in FIG. 13 and as described in Example 8. The methods and apparatuses described above can be adapted and/or combined to form core-sheath fibers using a round vessel having a round slit. Core polymers and sheath polymers can be provided to the slit in a round vessel using nested annular flow paths, as is illustrated in FIG. 13E; these annular flow paths are compatible with piston-driven, hydraulically-driven, or pneumatically driven polymer systems described above.

Figure 5:
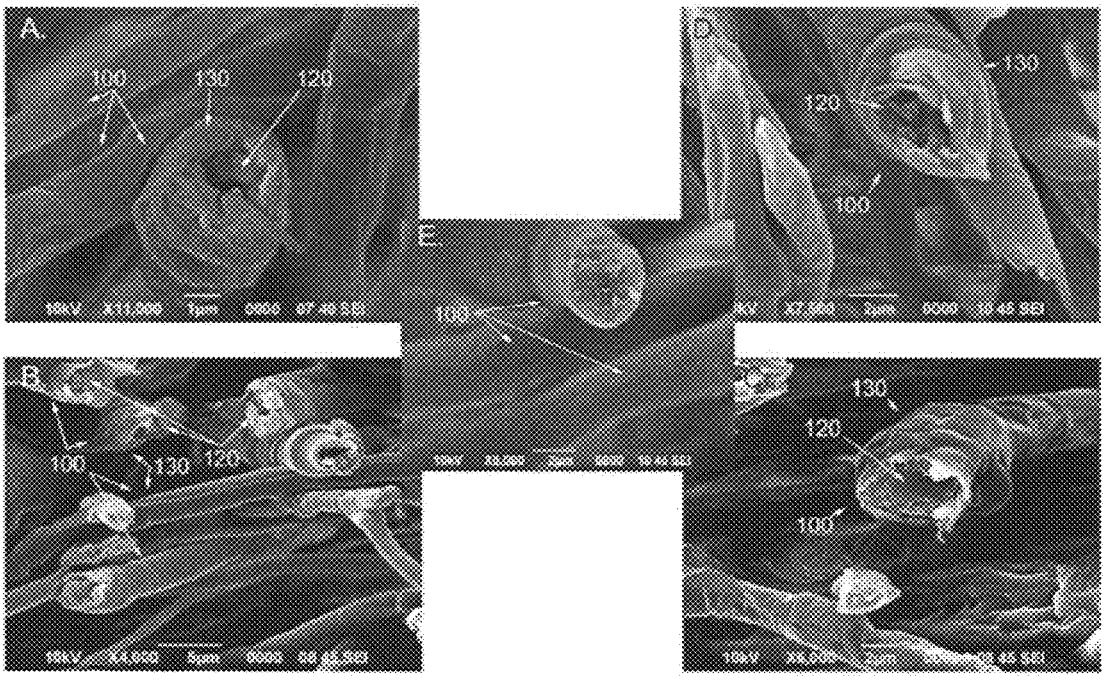
FIG. 5 includes scanning electron micrographs of electrospun core-sheath and homogeneous fibers formed on apparatuses of the invention.
Figure 15:
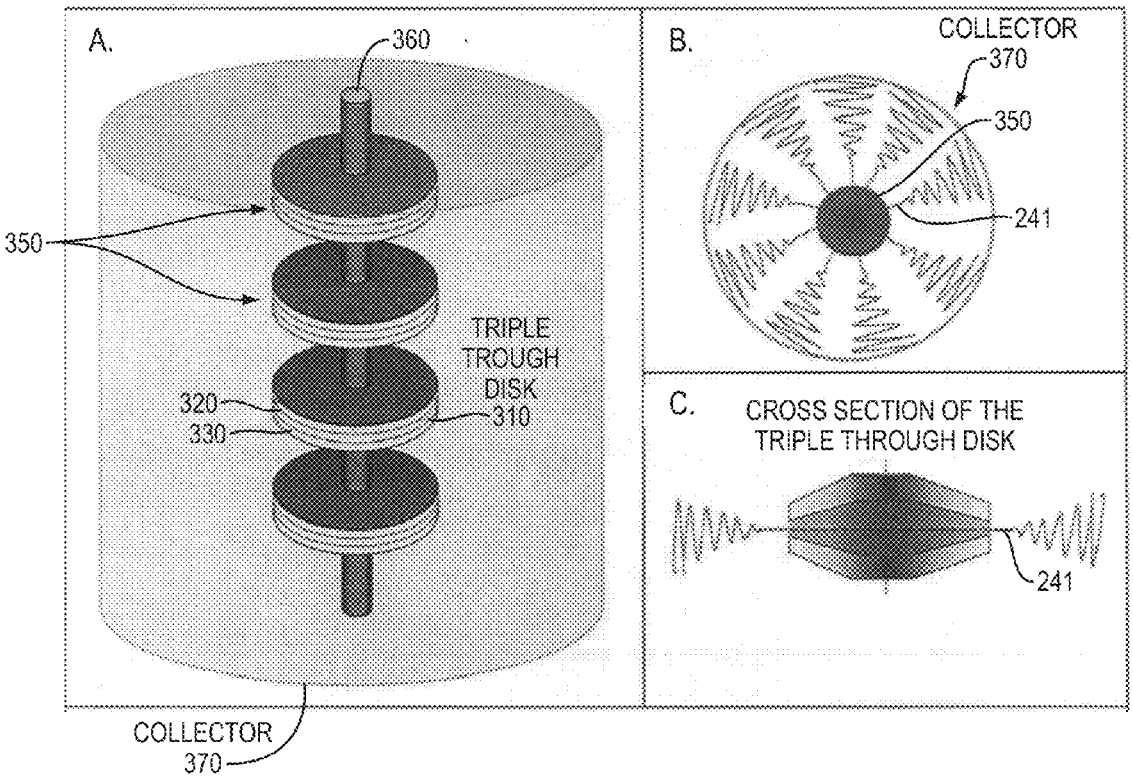
FIG. 15 includes schematic depictions of apparatuses according to embodiments of the invention.

In addition, although the disclosure focuses on systems and methods utilizing a single lengthwise slit, any suitable aperture geometry may be used, including without limitation multiple short slits, holes, curved slits, slits and holes together, etc. Similarly, the invention includes systems and methods utilizing complex three-dimensional arrangements, such as that shown in FIG. 15, utilizing multiple disks 350, each disk containing three troughs in a manner similar to that shown in FIG. 5-*a* central trough 310 for the core polymer solution 220 flanked by troughs 320, 330 for the sheath polymer solution 260. In the system of FIG. 15, the core and sheath polymer solutions are supplied by a central line 360 connected to each disk. Upon application of an electrical field, Taylor cone formation and formation of electrospinning jets occurs in a radially outward direction, and the resulting fibers are collected on a grounded collector 370 disposed circumferentially about and at a suitable distance from the disks 350.

Preferred embodiments of the invention utilize elongate areas including slits for electrospinning. Using elongate areas rather than, say, radially symmetrical or square areas advantageously permits multiple solutions or materials to be continuously and evenly supplied to sites of Taylor cone and electrospinning jet formation such that they are closely apposed, yet remain separate. In non-elongate areas such as squares, Taylor cones and electrospinning jets that form in the center of the area tend to deplete the supply of materials or polymer solutions in the center of the area, which materials cannot be replaced as efficiently and evenly while remaining in an unmixed fashion as is possible in narrower, more elongate areas. In addition, the use of elongate areas provides a straightforward path to scaling-up fiber production: as the long dimension of the elongate area increases, it is possible to form more Taylor cones and electrospinning jets within the area, yet by keeping a short dimension relatively constant, materials and polymer solution can be rapidly supplied from alongside or underneath the area to prevent depletion. Suitable dimensions for slits in apparatuses of the invention are disclosed in Examples 7 and 8, below.

The systems and methods described herein can be adapted to form structures other than core-sheath fibers. For example, core-sheath particles may be formed using core and/or sheath polymer solutions with low viscosity. Upon introduction on an electric field, Taylor cones and structures similar to electrospinning jets (which are referred to as "spray jets" herein) will form. Due to the low viscosity of the solutions, the spray jets will break-up midstream leading to particle formation. Optionally, vibration can be used to disrupt the flow of the core and/or sheath solutions to further encourage the formation of spray jets and/or particles.

The invention also includes combinations of the systems and methods described above. For example, structures incorporating multiple sheath polymers can be formed using a vessel/bath setup as described above in combination with a syringe pump to provide a second sheath polymer solution to sites of Taylor cone formation.

In some embodiments, one or more of the core polymer solution and the sheath polymer solution is delivered in a pulsatile manner to create fibers with gradients of core densities and/or sheath thicknesses.

Figure 16:
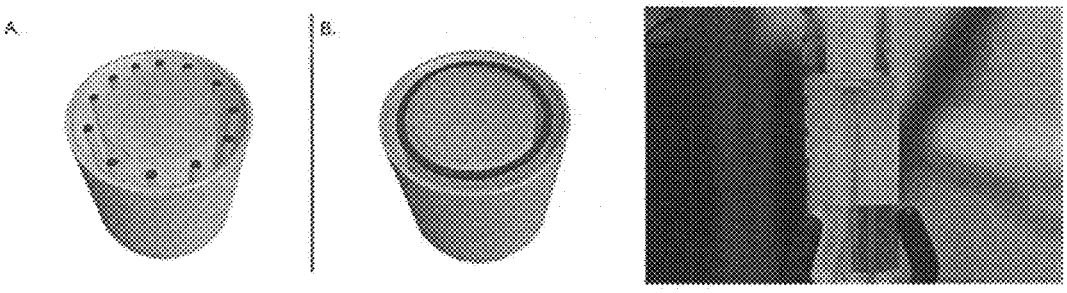
FIG. 16 includes schematic depictions of apparatuses according to embodiments of the invention.

The invention includes systems and methods in which limited or no structure is used to separate core and sheath polymer solutions 220, 260. As shown in FIG. 16C, multiple polymer solutions may mix poorly such that little or no structural separation between core and sheath polymer solutions 220, 260 is necessary to form structures with distinct cores and sheaths. In the embodiment depicted in FIGS. 16A-B, core polymer solution 220 is provided at discrete points within an electrospinning vessel; the remainder of the vessel is filled with sheath polymer solution, and a field is then applied to initiate electrospinning.

The devices and methods of the present invention may be further understood according to the following non-limiting examples:

Example 1

Electrospinning Conditions for Various Slit/Hole Geometries

Figure 10:
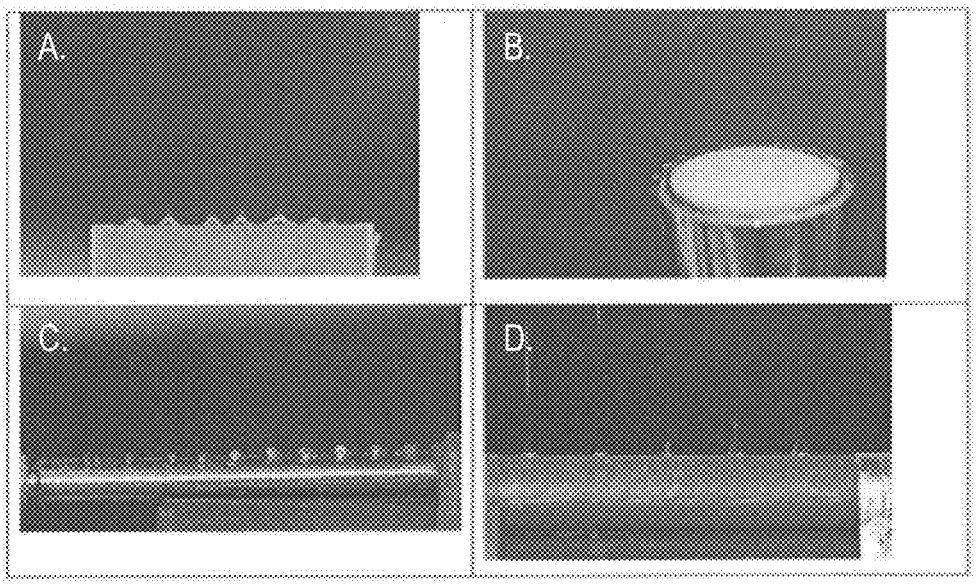
FIG. 10 includes photographs of apparatuses in accordance with the invention having varying geometries (linear and round) and varying slit arrangements (single slits, many holes, few holes).

Slit-surfaces of various geometries were fabricated and the formation of electrospinning jets from these surfaces was demonstrated. FIG. 10 shows slit-surfaces that are (A) continuously linear, (B) continuously circular, (C) continuously linear with holes, and (D) non-continuous holes. The respective dimensions of slits or holes and the electrospinning conditions used therefore are presented in Table 1, below:

TABLE 1

GEOMETRIES AND ELECTROSPINNING CONDITIONS FOR APPARATUSES SHOWN IN FIG. 10:

| Slit Geometry | Apparatus Geometry | Polymer solution | Slit dimensions | Flow rate | Flow Source | Electric field |
|---|---|---|---|---|---|---|
| Continuously linear | Wedge | 6 wt % PLGA 75/25 in TFE | 0.5 mm × 35 mm | 60 ml/hr | Underneath | 40 kV |
| Continuously circular | Annular or Showerhead | 2 wt % PLGA 85/15 in Chloroform/ Methanol(6:1) | 1 mm × 80 mm | 120 ml/hr | Underneath | 40 kV |
| Continuously linear with holes | Tube | 2.5 wt % PLGA 85/15 in Chloroform/ Methanol(6:1) | 8 cm long | 30 ml/hr | Ends | 40 kV |
| Non-continuous holes | Tube | 2.5 wt % PLGA 85/15 in Chloroform/ Methanol(6:1) | 5 cm long | 20 ml/hr | Ends | 40 kV |

Example 2

Achieving Even Flow of Polymer Solutions Using Mechanical Piston

Figure 17:
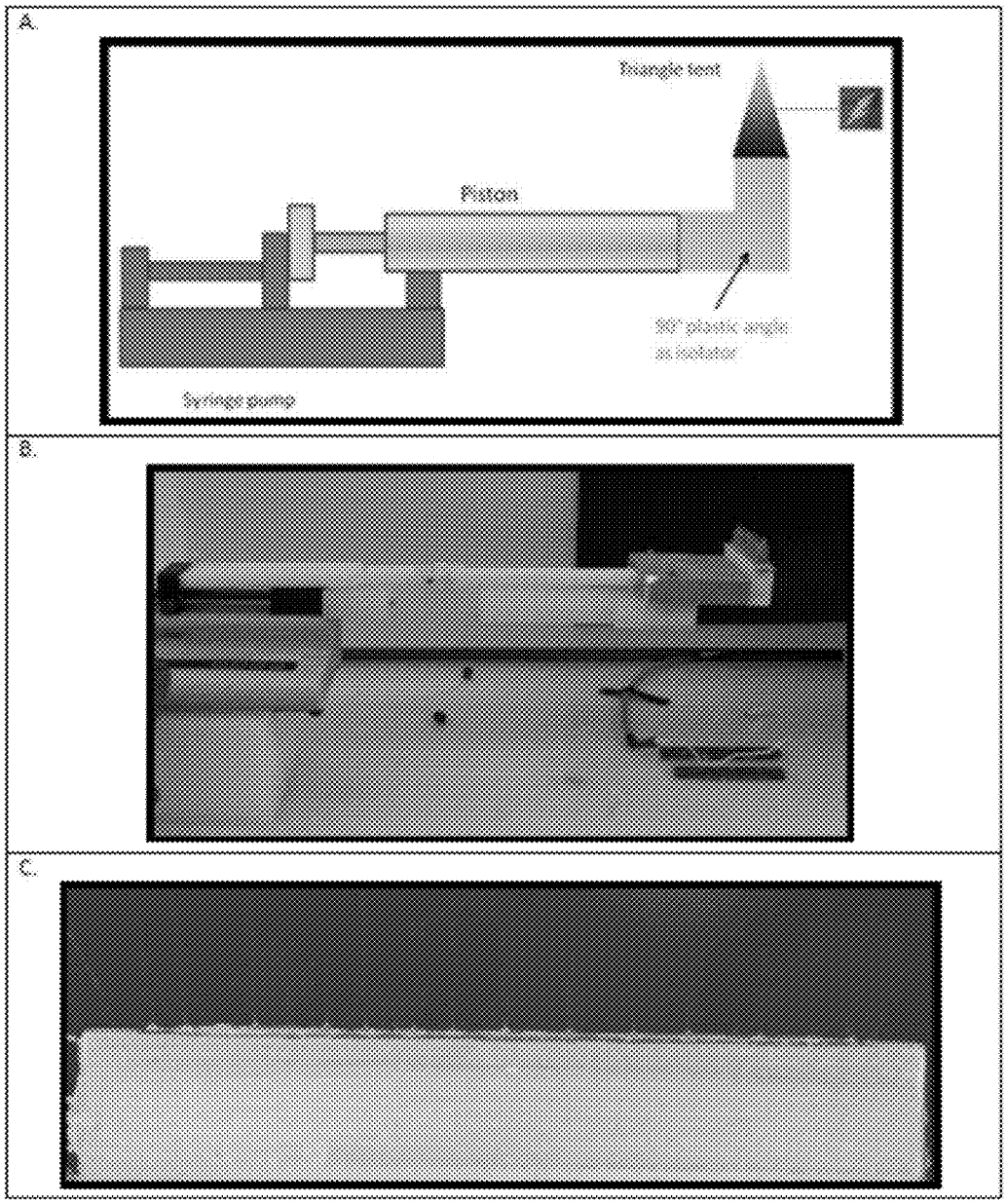
FIG. 17 includes schematic depictions of apparatuses according to embodiments of the invention.

Even flow of polymer solution to a slit was achieved by the use of a mechanical piston. FIG. 17A-B depicts the apparatus used. The wedge-shaped slit fixture is attached to a chamber connected to a piston that is mechanically driven using a syringe pump. As the piston moves forward, it pushes solution uniformly towards the slit. Using a flow rate of 50 ml/h and a voltage of 50 kV, multiple electrospinning jets emerged along the entire length of the slit as shown in 25C.

Example 3

Achieving Even Flow of Polymer Solutions Using Pressure Diffusers

Even flow of polymer solution to the slit was achieved by incorporating pressure diffusers to divert momentum of fluid flow across the slit. Shown in FIG. 11 are examples of such diffusers. In FIG. 11A, the diffuser is a triangular fixture that contains holes across its length to allow polymer solution to flow through. To demonstrate its ability to divert fluid flow, the diffuser was press-fit inside a container such that flow of solution is forced through its holes rather than around. As shown in FIG. 11B, a dyed solution of PLGA in chloroform: methanol that was pumped into the container from one inlet source encounters the diffuser, spreads across the length of the chamber, and then flows through the holes of the diffuser. The result is a more even distribution of fluid flow across the length of the chamber. Similarly, FIG. 11C shows a circular shaped pressure diffuser that contains holes across its surface. As shown in FIG. 11D series of these diffusers were press fit into a tube and filled with non-dyed polymer solution of PLGA in chloroform:methanol. A dyed solution of the same solution was then pumped into the tube from one inlet source at the bottom. Similar as before, the solution encounters the diffusers, spreads across the area of the tube, and then passes through the holes of the diffuse. The result is a more even distribution of fluid flow across the tube. Pressure diffusers can be incorporated into the apparatus of the invention to achieve even flow of polymer to the slit surface.

Example 4

Achieving Even Flow of Polymer Solutions Using Polymer Solution Re-Direction

Another method for even flow can be achieved by redirecting polymer solution to flow in the opposite direction of initial direction. Shown in FIG. 20 is an experiment in which a 2 wt % PEO solution in 60:40 (by vol) ethanol:water is pumped through a tube that faces down inside a container. The tube is placed 10 mm away from the bottom of the container and fluid flow is set at 50 ml/h. The solution contains a blue dye to visualize the fluid flow pattern. As demonstrated, solution initially travels in the downward direction and upon encountering the wall of the container, proceeds to spread across the bottom and rise up uniformly. This diversion of momentum of fluid flow concept can be incorporated into the apparatus of the invention to achieve even flow of polymer to the slit surface.

Example 5

Electrospinning of Core-Sheath Fibers Using Direct Feed of Polymer Solutions

Core-sheath fibers were manufactured using an apparatus according to the embodiment of FIGS. 1 and 2. The apparatus consists of an inner trough with a slit width of 0.5 mm, while the width of the outer trough is 2 mm. The length of the entire slit is 7 cm. These wedge-shaped slits were affixed to a base fixture that allowed polymer solution to be directly delivered from inlet ports originating from the underside of the fixture.

A sheath solution 260 of 2.8 wt % 85/15 PLGA in 6:1 (by vol) chloroform/methanol and a core solution 230 of 2.8 wt % 85/15 PLGA in 6:1 (by vol) chloroform/methanol containing 30% wt % dexamethasone drug with respect to PLGA was used. The sheath flow rate was set at 100 ml/h while the core flow rate was set at 50 ml/h. A voltage of 50 kV was applied.

Example 6

Electrospinning of Core-Sheath Fibers Using Pneumatic Feed of Polymer Solutions

Core-sheath fibers were manufactured using an apparatus according to the embodiment of FIGS. 1-2 and 6. The apparatus consists of an inner trough capable of holding 50 mls of polymer solution and outer troughs capable of holding 100 mls of sheath polymer solution. The slit width of the inner trough is 0.5 mm, while the width of the outer trough is 2 mm. The length of the slit is 3.5 cm. Polymer solution was delivered to the respective slits via pneumatic actuation using a syringe pump and empty syringe. A sheath solution of 6 wt % PLGA in hexafluoroisopropanol (HFIP) was delivered at 60 mL/min and a core solution 230 of 15 wt % PCL in 6:1 (by vol) chloroform/methanol containing 30% wt % dexamethasone drug with respect to PCL was delivered at a rate of 10 mL/min. A voltage of 50-60 kV was applied and numerous core-sheath jets were emitted from the slit-surface of the apparatus and fibers were collected. FIG. 3 shows multiple core-sheath Taylor cones 240 and electrospinning jets 241 emanating from the slit 270 when the apparatus is in use. The core-sheath structure of the resulting fibers was confirmed by scanning electron microscopy, as shown in FIGS. 5A-D, which includes multiple scanning electron micrographs of fibers 100 having distinct cores 120 comprising dexamethasone particles and sheaths 130. FIG. 5E shows a control fiber made from a single PLGA/PCL/dexamethasone blend which does not exhibit the core-sheath structure.

Example 7

Electrospinning of Core-Sheath Fibers Using Pneumatic Feed of Polymer Solutions

Fibers with various core-sheath structures were fabricated using an apparatus according to the embodiment of FIGS. 1-2 and 6. Core-sheath structure was varied by varying the outer sheath flow rate while keeping the core flow rate constant. The sheath solution 260 consisted of 6 wt % PLGA in hexafluoroisopropanol (HFIP) while the core solution 230 consisted of 15 wt % PCL in 6:1 (by vol) chloroform/methanol containing 30% wt % dexamethasone drug with respect to PCL. The core flow rate was kept constant at 20 ml/h while the sheath flow rate was adjusted to either 40 or 100 ml/h. A control fiber made from a PLGA/PCL/dexamethasone blend was also fabricated. To evaluate the different core-sheath structures, elution of the dexamethasone drug from fibers was evaluated. Varying the sheath flow rate had the effect of varying the release kinetics of dexamethasone. Without wishing to be bound to any theory, the inventors hypothesize that greater sheath flow rates led to thicker sheaths, which restricted diffusion of drug from fiber cores more completely than in fibers formed in conditions of lower sheath flow.

Example 8

Electrospinning from Circular Fixture

An apparatus incorporating a round slit rather than a linear one has been used. A showerhead fixture was modified, replacing a center piece with a plug to form a circumferential slit. When a 1 wt % PLGA solution was provided to the slit, multiple Taylor cones and electrospinning jets were observed, as shown in FIGS. 13 A and D.

The term "and/or" is used throughout this application to mean a non-exclusive disjunction. For the sake of clarity, the term A and/or B encompasses the alternatives of A alone, B alone, and A and B together. The aspects and embodiments of the invention disclosed above are not mutually exclusive, unless specified otherwise, and can be combined in any way that one skilled in the art might find useful or necessary.

The term "elongate" is used throughout this application to refer to structures having at least two dimensions, one dimension being longer, and preferably substantially longer, than the other(s). For the sake of clarity, the term "elongate" encompasses structures that are linear, cylindrical, cuboidal, curved, curvilinear, toroidal, annular, angled, rectangular, etc. and any structure that could be formed by bending or curving one of the elongate structures listed above.

While several embodiments of the present invention have been described and illustrated herein, those of ordinary skill in the art will readily envision a variety of other means and/or structures for performing the functions and/or obtaining the results and/or one or more of the advantages described herein, and each of such variations and/or modifications is deemed to be within the scope of the present invention. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings of the present invention is/are used. Those skilled in the art will recognize, or be able to ascertain using no more than routine experimentation, many equivalents to the specific embodiments of the invention described herein. It is, therefore, to be understood that the foregoing embodiments are presented by way of example only and that, within the scope of the appended claims and equivalents thereto, the invention may be practiced otherwise than as specifically described and claimed. The present invention is directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the scope of the present invention.

The breadth and scope of the invention is intended to cover all modifications and variations that come within the scope of the following claims and their equivalents:

We claim:

1. A method of forming a structure, the structure comprising a core including a first material and a sheath including a second material around said core, the method comprising the steps of:

providing an apparatus, comprising:

a first wedge-shaped vessel having a first slit and comprising an electrically conductive material;

a second wedge-shaped vessel having a second slit, wherein the first wedge-shaped vessel is disposed inside of the second wedge-shaped vessel;

first and second fluid reservoirs containing the first and second materials, respectively, wherein the first and second fluid reservoirs are in fluid communication with the first and second wedge-shaped vessels, respectively; and a voltage source configured to apply a voltage to at least one of the first and second materials;

activating the voltage source to apply a voltage of between 1 and 250 kV;

moving the first material from the first fluid reservoir to the first wedge-shaped vessel; and moving the second material from the second fluid reservoir to the second wedge-shaped vessel.

2. The method of claim 1, wherein the structure is an elongate fiber.

3. The method of claim 1, wherein the apparatus includes a collecting area having at least one electrically grounded point thereon, the method further comprising the step of collecting the structure within the collecting area.

4. The method of claim 1, wherein the step of moving the first fluid from the first fluid reservoir to the first wedge-shaped vessel includes supplying a gas to the first fluid reservoir at a substantially constant pressure.

5. The method of claim 1, wherein the step of moving the first fluid from the first fluid reservoir to the first wedge-shaped vessel includes moving a piston within the first fluid reservoir at a constant rate.

6. The method of claim 1, wherein the step of moving the second fluid from the second fluid reservoir to the second wedge-shaped vessel includes moving a gas into the second fluid reservoir at a substantially constant pressure.

7. The method of claim 1, wherein the step of moving the second fluid from the second fluid reservoir to the second wedge-shaped vessel includes moving a piston within the second fluid reservoir at a substantially constant rate.

8. The method of claim 1, wherein the voltage applied in the step of activating the voltage source is between 1 and 100 kV.

9. The method of claim 1, wherein the first slit is positioned at an apex of the first wedge-shaped vessel.

10. The method of claim 9, wherein the second slit is positioned at an apex of the second wedge-shaped vessel.

11. The method of claim 10, wherein the first and second slits are aligned.

12. A method of forming an elongate fiber, the elongate fiber comprising a core including a first material and a sheath including a second material around said core, the method comprising the steps of:

providing an apparatus, comprising:

a first wedge-shaped vessel having a first slit and comprising an electrically conductive material;

a second wedge-shaped vessel having a second slit, wherein the first wedge-shaped vessel is disposed inside of the second wedge-shaped vessel;

first and second fluid reservoirs containing the first and second materials, respectively, wherein the first and second fluid reservoirs are in fluid communication with the first and second wedge-shaped vessels, respectively;

a voltage source configured to apply a voltage to at least one of the first and second materials; and a collecting area having at least one electrically grounded point thereon;

activating the voltage source to apply a voltage of between 1 and 250 kV;

moving the first material from the first fluid reservoir to the first wedge-shaped vessel;

moving the second material from the second fluid reservoir to the second wedge-shaped vessel; and collecting the elongate fiber within the collecting area.

13. The method of claim 12, wherein the step of moving the first fluid from the first fluid reservoir to the first wedge-shaped vessel includes supplying a gas to the first fluid reservoir at a substantially constant pressure.

14. The method of claim 12, wherein the step of moving the first fluid from the first fluid reservoir to the first wedge-shaped vessel includes moving a piston within the first fluid reservoir at a constant rate.

15. The method of claim 12, wherein the step of moving the second fluid from the second fluid reservoir to the second wedge-shaped vessel includes moving a gas into the second fluid reservoir at a substantially constant pressure.

16. The method of claim 12, wherein the step of moving the second fluid from the second fluid reservoir to the second wedge-shaped vessel includes moving a piston within the second fluid reservoir at a substantially constant rate.

17. The method of claim 12, wherein the voltage applied in the step of activating the voltage source is between 1 and 100 kV.

18. The method of claim 12, wherein the first slit is positioned at an apex of the first wedge-shaped vessel.

19. The method of claim 18, wherein the second slit is positioned at an apex of the second wedge-shaped vessel.

20. The method of claim 19, wherein the first and second slits are aligned.

* * * * *